US005290475A

United States Patent [19]

Wixon

[11] Patent Number: 5,290,475

[45] Date of Patent: Mar. 1, 1994

[54] LIQUID SOFTENING AND ANTI-STATIC NONIONIC DETERGENT COMPOSITION WITH SOIL RELEASE PROMOTING PET-POET COPOLYMER

[75] Inventor: Harold E. Wixon, New Brunswick, N.J.

[73] Assignee: Colgate Palmolive, New York, N.Y.

[21] Appl. No.: 935,133

[22] Filed: Aug. 21, 1992

Related U.S. Application Data

[63] Continuation of Ser. No. 744,633, Aug. 7, 1991, abandoned, which is a continuation of Ser. No. 520,421, May 8, 1990, abandoned.

[51] Int. Cl.[5] ..... C11D 3/37; C11D 1/12

[52] U.S. Cl. ..... 252/174.23; 151/8.75; 151/8.8; 151/8.7; 151/DIG. 2; 151/DIG. 15; 151/174.21

[58] Field of Search ..... 252/174.23, 8.75, 8.7, 252/8.8, DIG. 2, DIG. 15, 174.24

[56] References Cited

U.S. PATENT DOCUMENTS

| | | | |
|---|---|---|---|
| 4,240,918 | 12/1980 | Lagasse et al. | 252/95 |
| 4,702,857 | 10/1987 | Gosselink | 252/174.21 |
| 4,751,008 | 6/1988 | Crossin | 252/8.8 |
| 4,790,856 | 12/1988 | Wixon | 8/137 |
| 4,824,582 | 4/1989 | Nayar | 252/8.75 |
| 4,883,610 | 11/1989 | Ciallella | 252/559 |
| 4,908,039 | 3/1990 | Holland et al. | 8/137 |
| 4,925,577 | 5/1990 | Borcher, Sr. et al. | 252/8.9 |
| 4,956,447 | 9/1990 | Gosselink et al. | 528/272 |
| 4,999,128 | 3/1991 | Sonenstein | 252/174.14 |
| 5,026,400 | 6/1991 | Holland | 8/137 |
| 5,110,506 | 5/1992 | Ciallella | 252/559 |

*Primary Examiner*—Paul Lieberman
*Assistant Examiner*—Kery A. Fries
*Attorney, Agent, or Firm*—Richard E. Nanfeldt; Robert C. Sullivan; Murray Grill

[57] ABSTRACT

A liquid softening and anti-static nonionic detergent composition comprises, as essential ingredients, a nonionic detergent, an anionic detergent, a cationic fabric softener-anti-static agent and a soil release promoting polymer of a water-soluble fraction of the polyethylene terephthalate-polyoxyethylene terephthalate type.

17 Claims, No Drawings

LIQUID SOFTENING AND ANTI-STATIC NONIONIC DETERGENT COMPOSITION WITH SOIL RELEASE PROMOTING PET-POET COPOLYMER

This is a continuation of co-pending application Ser. No. 07/744,633 filed on Aug. 7, 1991, now abandoned and which was a continuation of application Ser. No. 07/520,421 filed May 8, 1990, now abandoned.

BACKGROUND OF THE INVENTION

1. Field of the Invention

This invention relates to a detergent-softening composition. More specifically, the present invention relates to softening/anti-static compositions adapted for use in the wash cycle of a laundering operation, the composition including as essential ingredients a nonionic detergent, an anionic detergent, a cationic fabric softener-anti-static agent and a soil release promoting polymer of the polyethylene terephthalate-polyoxyethylene terephthalate (PET-POET) type.

2. Description of the Prior Art

Compositions useful for treating fabrics to improve the softness and feel characteristics thereof are known in the art.

When used in domestic laundering, the fabric softeners are typically added to the rinse water during the rinse cycle having a duration of only from about 2 to 5 minutes. Consequently, the consumer is required to monitor the laundering operation or take other precautions so that the fabric softener is added at the proper time. This requires the consumer to return to the washing machine either just prior to or at the beginning of the rinse cycle of the washing operation which is obviously burdensome to the consumer. In addition, special precaution has to be taken to use a proper amount of the fabric softener so as to avoid over dosage which may render the clothes water repellant by depositing a greasy film on the fabric surface, as well as imparting a certain degree of yellowness to the fabrics.

As a solution to the above-noted problems, it has been known to use fabric softeners which are compatible with common laundry detergents so that the softeners can be combined with the detergents in a single package for use during the wash cycle of the laundering operation. Examples of such wash cycle added fabric softening compositions are shown in U.S. Pat. Nos. 3,351,438, 3,660,286 and 3,703,480 and many others. In general, these wash cycle fabric softening compositions contain a cationic quaternary ammonium fabric softener and additional ingredients which render the softening compounds compatible with the common laundry detergents.

It is also known, however, that the cationic softening compounds added to the wash cycle, either as an ingredient in a detergent-softener composition or as a wash cycle softener, interfere with the brightening activity, as well as the cleaning efficiency of the detergent. As a result, it has been sought to offset to some degree this interference in detergent-softening compositions by using nonionic surfactants, higher levels of brightener compound, carboxymethylcellulose, anti-yellowing compounds, bluing agents and so forth. However, little improvement has been made in wash cycle softening compositions using a variety of detergents, most of which are anionics.

There have been many disclosures in the art relating to detergent compositions containing cationic softening agents, including the quaternary ammonium compound softening agents, and nonionic surface-active compounds. As representative of this art, mention can be made of U.S. Pat. Nos. 4,264,457; 4,239,659; 4,259,217; 4,222,905; 3,951,879; 3,360,470; 3,351,483; 3,644,203; etc. In addition, U.S. Pat. Nos. 3,537,993; 3,583,912; 3,983,079; 4,203,872, and 4,264,479, specifically disclose combinations of nonionic surface-active agent, cationic fabric softener and another ionic surfactant or modifier, such as zwitterionic surfactants, amphoteric surfactants, and the like.

While many of these prior art formulations provide satisfactory cleaning and/or softening under many different conditions they still suffer from the defects of not providing adequate softening—e.g. comparable to rinse cycle—added softeners.

U.S. Pat. No. 3,920,565 discloses a liquid rinse cycle fabric softener composition containing 2 to 15% of a cationic fabric softener and 0.5 to 4.0% of an alkali metal salt of a fatty acid of from 16 to 22 carbon atoms (soap) and optionally, up to 2% of a nonionic emulsifier, the balance water. The di-higher alkyl dimethyl ammonium chlorides are the preferred cationics, although mono-higher alkyl quats are also mentioned.

It is generally accepted in the art that the mono-higher alkyl quaternary ammonium compounds, such as, for example, stearyltrimethyl ammonium chloride, being relatively water-soluble, are less effective softeners that the di-higher alkyl cationic quaternary softeners (see, for example, U.S. Pat. No. 4,326,965), and, therefore, their use in conjunction with, for example, anionic detergents, such as fatty acid soaps, with which they are capable of forming softening complexes has been suggested for use as rinse cycle fabric softeners.

The present inventor previously discovered that stable, fabric softening compositions having improved dispersibility in cold water as used in the rinse cycle, are provided by a cationic quaternary ammonium compound, as the sole softener, and an anionic sulfonate at a weight ratio of cationic to anionic of from about 80:1 to 3:1 (see U.S. Pat. No. 3,997,453). This patent discloses both mono-higher and di-higher alkyl cationic quaternary softening compounds and also discloses alkyl benzene sulfonates as the anionic compound. According to this patent, the addition of minor amounts of the anionic sulfonate to water dispersions of the excess amount of quaternary softener reduces the viscosity of the dispersion and produces a homogeneous liquid which is readily dispersible in cold water (i.e. the rinse cycle of an automatic washing machine).

As mentioned above, however, it has been recognized for some time that it would be highly desirable as a matter of convenience to employ the fabric softening formulation concurrently with the detergent in the wash cycle of the washing machine.

U.S. Pat. No. 4,222,905 to Cockrell, Jr. discloses laundry detergent compositions which may be in liquid form and which are formulated from certain nonionic surfactants and certain cationic surfactants, including mono-higher alkyl quaternary ammonium compounds, such as tallowalkyltrimethyl ammonium halide, at a nonionic:cationic weight ratio of from 5:1 to about 1:1. This patent teaches that the amount of anion-producing materials should be minimized and preferably totally avoided, but in any case, anionic materials having a dissociation constant of less than $1\times10^{-5}$, such as sodium $C_{11.8}$ linear alkylbenzene sulfonate, should be contained only in amounts up to 10%, by weight, of the cationic surfactant.

Nonionic/cationic mixed surfactant detergent compositions having a nonionic:cationic weight ratio of from about 1:1 to 40:1 in which the nonionic surfactant is of the class having a hydrophilic-lipophilic balance (HLB) of from about 5 to about 17, and the cationic surfactant is of the class of mono-higher alkyl quaternary ammonium compounds in which the higher alkyl has from about 20 to about 30 carbon atoms, are disclosed by Murphy in U.S. Pat. No. 4,239,659. This patent provides a general disclosure that other adjunct components may be included in their conventional art-established levels for use which is stated to be from about 0 to about 40%. A broad list of adjunct components is given including semi-polar nonionic, anionic, zwitterionic and ampholytic cosurfactants, builders, dyes, fillers, enzymes, bleaches, and many others. There are no examples using, and no disclosure of, anionic surfactants, however, it is stated that the cosurfactants must be compatible with the nonionic and cationic and can be any of the anionics disclosed in U.S. Pat. No. 4,259,217 to Murphy.

This latter Murphy patent discloses surfactant mixtures of nonionic surfactants having an HLB of from about 5 to about 17 and a cationic surfactant, inclusive of mono-higher alkyl quaternary ammonium compounds, at a nonionic:cationic weight ratio of from 5.1:1 to about 100:1. According to this patent, the detergent compositions may contain up to about 50%, preferably from about 1 to about 15%, of anionic surfactants and/or zwitterionic surfactants. The anionic surfactants include, among others, linear alkyl benzene sulfonates and alkyl ether sulfates. Example XV in column 40 of this patent describes a heavy duty liquid laundry detergent composition of the following formula:

| Component | Weight |
|---|---|
| Sodium sulfate of $C_{12-15}$ alcohol ethoxylated with 3 moles of ethylene oxide | 5.0 |
| $C_{12-13}$ alcohol ethoxylate containing an average of 6.5 moles ethylene oxide | 20.0 |
| Coconutalkyltrimethyl ammonium chloride | 3.5 |
| Glycine | 8.0 |
| Sodium toluene sulfonate | 10.0 |
| Water and minors | Balance to 100. |

The following heavy duty liquid detergent composition is shown in Example XVII (column 41):

| Component | Weight |
|---|---|
| Condensate of $C_{14-15}$ fatty alcohol with an average of 7 moles of ethylene oxide | 28.5 |
| Triethanolamine salt of linear alkylbenzene sulfonic acid wherein the alkyl chain has an average of 11.9 carbon atoms | 20.0 |
| $C_{8-18}$ alkyldihydroxyethyl methyl ammonium chloride | 1.5 |
| Ethanol | 10.0 |
| Diethylenetriamine pentamethyl phosphonic acid | 0.3 |
| Citric acid | 0.2 |
| 9.1 mixture of dimethylpolysiloxane and acrogel silica emulsified in highly ethoxylated fatty acid (commercially available from Dow Corning as DB31) | 0.3 |
| Saturated fatty acid having from 16 to 22 carbon atoms in the alkyl chain | 0.75 |
| Proteolytic enzyme | 0.4 |

-continued

| Component | Weight |
|---|---|
| Minor adjuvants and water | Balance to 100. |

A liquid laundry detergent and fabric softener composition which contains about 3-35% by weight of a nonionic surfactant, about 3-30% by weight mono-higher alkyl quaternary ammonium compound cationic surfactant and a mixture of anionic surfactants including (a) $C_4$-$C_{10}$ alcohol sulfates and (b) $C_{12}$-$C_{22}$ alcohol ethoxylated ether sulfates or carboxylates is disclosed in U.S. Pat. No. 4,264,457 to Beeks and Wysocki. The mole ratio of total cationic surfactant to total anionic surfactant can vary from 0.8:1 to 10:1. According to the patentees, the selection of and proportions of the two specific anionic surfactants to the exclusion of other known anionic surfactants is essential to obtain the maximal effectiveness for detergency, softness and anti-static properties.

The present inventor has also previously discovered that softening and anti-static performance of a detergent compound and a cationic mono-higher alkyl quaternary ammonium compound fabric softening agent is significantly enhanced by using the cationic softener as an approximately 1:1 complex with an anionic surfactant which is a linear alkyl aromatic sulfonate. This discovery is the subject matter of applicant's copending application Ser. No. 661,775, filed Oct. 17, 1984, the disclosure of which is incorporated herein by reference. Furthermore, this enhancement of the softening/anti-static performance was achieved without sacrificing, and in some cases, with significant improvement in the whitening and cleaning performance.

While excellent softening and anti-static benefits have been provided by the liquid nonionic detergent compositions based on the complex of the cationic fabric softener and linear alkyl benzene sulfonate, the present inventor has also previously discovered that further improvements in overall cleaning performance and the ability to form complexes of the mono-higher alkyl quaternary fabric softener with a broader range of commercially available anionic detergents can both be attained by adding to the composition an additional surfactant compound which is a sulfosuccinamate compound. This discovery is the subject matter of applicant's copending Ser. No. 873,486, filed Jun. 12, 1986, now U.S. Pat. No. 4,790,856 the disclosure of which is incorporated herein by reference. The incorporation of the sulfosuccinamate compound significantly boosts detergency of the nonionic/cationic mixture with or without the additional benefits of other anionic surfactants.

The use of polyethylene terephthalate-polyoxyethylene terephthalate (PET-POET) soil release promoting polymers is well documented in the patent literature. Representative examples of the patent literature disclosing the use of PET-POET and similar polymers in the treatment of synthetic textile materials, in general, and in laundry detergent compositions, in particular, include, among others, U.S. Pat. No. 3,557,039 (and its corresponding British Patent Specification 1,088,984); U.S. Pat. Nos. 3,652,713; 3,723,568; 3,959,230; 3,962,152; 4,125,370; 4,132,680; 4,569,772; and British Patent Specifications 1,154,370; 1,317,278; 1,377,092; and British Published Patent application 2,123,848 A.

U.S. Pat. No. 3,557,039 to McIntyre et al. shows the preparation of such copolymers by the ester interchange and subsequent polymerization of dimethyl terephthalate (DMT) and ethylene glycol (EG) in the presence of a mixed catalyst system of calcium acetate hemihydrate and antimony trioxide. A similar reaction is shown in U.S. Pat. No. 3,959,280 to Hays, this patent further using polyethylene oxide as one reactant in addition to DMT and EG monomers. The PET-POET copolymers of Hays are characterized by a molar ratio of ethylene terephthalate units to polyethylene oxide terephthalate units of from about 25:75 to about 35:65, by the polyethylene oxide of the polyethylene oxide terephthalate having a molecular weight of from about 300 to 700, by a molecular weight of about 25,000 to about 55,000, and by a melting point below 100° C.

U.S. Pat. No. 3,652,713 forms antistatic fibers, films and other shaped articles from compositions in which polyethylene terephthalate is mixed with a polyether-polyester block copolymer such that the polyether segment constitutes from 0.1 to 10.0% by weight based on the total weight of the mixture. The polyether-polyester block copolymer can be prepared by melt-polymerizing (condensation polymerization) polyethylene terephthalate of number average molecular weight of from 1,000 to 2,000 with polyethylene glycol having a number average molecular weight of from 1,000 to 50,000 at a highly reduced pressure and elevated temperature in the presence of antimony trioxide and trimethyl phosphate.

According to British 1,317,278 to Ambler et al. high molecular weight (e.g., spinning-grade or film-forming) polyethylene terephthalate is reacted with polyethylene glycol (MW=300 to 30,000) at temperatures in the range of 100° C. to 300° C., preferably at atmospheric pressure in the presence of conventional ester exchange catalyst, for example, antimony oxides, calcium acetate, tetralkyltitanates and stannous octoate.

U.S. Pat. No. 4,125,370 to Nicol discloses PET-POET soil release promoting random copolymers having an average molecular weight in the range of about 5,000 to about 200,000, with a molar ratio of ethylene terephthalate to polyethylene oxide terephthalate of from about 20:80 to 90:10, the polyethylene oxide linking unit having a molecular weight in the range from about 300 to 10,000. These polymers can be prepared according to the procedure disclosed in the aforementioned U.S. Pat. No. 3,959,280 to Hays or by the process described in U.S. Pat. No. 3,479,212 to Robertson et al.

PET-POET soil release promoting polymers are also commercially available, for example, the products Alkaril QCJ and QCF from Alkaril Chemicals, Inc.; Milease T from ICI America; and Zelcon from E. I. du-Pont de Nemours & Co.

While satisfactory soil release promoting property has been obtained from the commercially available products and as described in the literature, there have been problems with regard to the stability, as well as effectiveness, of these copolymers during storage and under actual use conditions. Thus, U.S. Pat. No. 4,125,370 teaches providing a concentration of certain hardness ions to promote deposition of the soil release polymers on the fabrics being washed and to promote soil release performance. U.S. Pat. No. 4,569,772 teaches that detergent compositions containing PET-POET polymers tend to lose their soil release promoting properties on storage, if the compositions contain alkaline builders. The patentees overcome this tendency by co-melting the PET-POET copolymer with a water-soluble alkali metal polyacrylate and converting the melt to solid particles. British Published Patent application 2,123,848 A overcomes this tendency by uniformly distributing the PET-POET copolymer throughout the particulate detergent product by preparing particles of a builder or a mixture of builders for a non-ionic detergent, dissolving and/or dispersing in such non-ionic detergent in liquid state a substantially anhydrous soil release promoting PET-POET polymer, and spraying such liquid non-ionic detergent-polymer mixture onto moving surfaces of the builder particles to distribute such non-ionic detergent and polymer over such particles.

While excellent softening and anti-static benefits have been provided by the liquid non-ionic detergent compositions based on the complex of the cationic fabric softener and anionic detergents such as linear alkyl benzene sulfonate, and while stable compositions of PET-POET polymers with non-ionic detergents have been achieved, there still exists a problem of incompatibility when formulating liquid detergents containing both cationic fabric softeners and commercially available PET-POET soil release promoting copolymers. In particular when a commercially available PET-POET soil release promoting copolymer, such as Alkaril QCJ, is added to a liquid detergent containing a non-ionic surfactant and an anionic surfactant, the liquid is slightly turbid, but the suspension is stable over time. When a cationic fabric softener is added to this liquid, the suspension becomes unstable, and a fine precipitate settles out over a period of time. This fine precipitate considerably degrades the appearance of the product to the consumer, especially when packaged in translucent containers and subjected to long-term storage prior to sale.

SUMMARY OF THE INVENTION

As a result of the inventor's further research, it has now been discovered that a stable liquid detergent composition containing both cationic fabric softener and PET-POET soil release promoting copolymer can be attained by utilizing a water-soluble fraction of the conventional PET-POET copolymer in lieu of the conventional PET-POET copolymer when formulating the liquid detergent.

Accordingly, it is an object of this invention to improve the soil release performance of detergent compositions containing non-ionic detergent compositions, anionic detergent compositions, and cationic fabric softener-anti-static agents.

It is another object of this invention to formulate stable, liquid detergent compositions using non-ionic detergent compositions, anionic detergent compositions, cationic fabric softener-anti-static agents and PET-POET-type soil release promoting copolymers.

These and other objects of the invention which will become apparent hereinafter are achieved by providing an aqueous laundry detergent composition useful for washing and softening soiled fabrics comprising a non-ionic detergent, an anionic detergent, a cationic fabric softener-anti-static agent and a water-soluble fraction of a polyethylene terephthalate-polyoxyethylene terephthalate soil release promoting polymer.

DETAILED DESCRIPTION OF THE INVENTION

The nonionic surfactants which are contemplated can generally be any of the nonionics known to be useful as detergents for cleaning soiled fabrics.

Suitable nonionic surface active agents are commercially available and are derived from the condensation of an alkylene oxide or equivalent reactant and a reactive-hydrogen hydrophobe. The hydrophobic organic compounds may be aliphatic, aromatic or heterocyclic, although the first two classes are preferred. The preferred types of hydrophobes are higher aliphatic alcohols and alkyl phenols, although others may be used such as carboxylic acids, carboxamides, mercaptans, sulphonamides, etc. The ethylene oxide condensates with higher-alkyl phenols or higher fatty alcohols represent preferred classes of nonionic compounds. Usually, the hydrophobic moiety should contain at least about 6 carbon atoms, and preferably at least about 8 carbon atoms, and may contain as many as about 50 carbon atoms or more, a preferred range being from about 8 to 22 carbon atoms, especially from 10 to 18 carbons for the aliphatic alcohols, and 12 to 20 carbons for the higher alkyl phenols. The amount of alkylene oxide will vary considerably depending upon the hydrophobe but as a general guide and rule, at least about 3 moles of alkylene oxide per mole of hydrophobe up to about 200 moles, preferably from about 3 to 50 moles, more preferably 5 to 20 moles of alkylene oxide per mole of hydrophobe will provide the required cleaning performance and compatibility with the other components.

Preferred classes of nonionic surfactants are represented by the formulae $$RO(CH_2CH_2O)_n \quad (I)$$

wherein R is a primary or secondary alkyl chain of from about 8 to 22 carbon atoms and n is an average of from 5 to 50, preferably 5 to 20, especially 6 to 13; and (II)

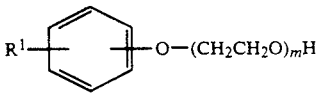

wherein $R^1$ is a primary or secondary alkyl chain of from 4 to 12 carbon atoms, and m is an average of 5 to 50, preferably 5 to 20, especially 6 to 13.

The preferred alcohols from which the compounds of formula (I) are prepared include lauryl, myristyl, cetyl, stearyl and oleyl and mixtures thereof. Especially preferred values of R are $C_{10}$ to $C_{18}$ with the $C_{12}$ to $C_{15}$ alkyls and mixtures thereof being especially preferred.

The preferred values of $R^1$ in formula (II) are from $C_6$ to $C_{12}$, with $C_8$ and $C_9$, including octyl, isooctyl and nonyl being especially preferred.

Typical examples of a nonionic compound of formula (I) are lauryl alcohol condensed with 5 or 7 or 11 moles ethylene oxide. Typical examples of a nonionic compound of formula (II) are isooctyl phenol or nonyl phenol condensed with 3 to 8 moles ethylene oxide.

Other nonionic compounds which may be used include the polyoxyalkylene esters of the organic acids such as the higher fatty acids, the rosin acids, tall oil acids, acids from petroleum oxidation products, etc. These esters will usually contain from about 10 to about 22 carbon atoms in the acid moiety and from about 3 to about 30 moles of ethylene oxide or its equivalent.

Still other nonionic surfactants are the alkylene oxide condensates with the higher fatty acid amides and amines. The fatty acid group will generally contain from about 8 to about 22 carbon atoms and this will be condensed with about 3 to about 30 moles of ethylene oxide as the preferreillustration. The corresponding carboxamides and sulphonamides may also be used as substantial equivalents.

Although ethylene oxide has been exemplified as the alkylene oxide group present in the nonionic surfactants, it is also within the scope of the invention to use nonionic surfactants formed with propylene oxide, preferably mixture of ethylene oxide and propylene oxide. For example, the nonionic surfactants sold under the well-known Plurafac series, such as Plurafac B-26, the reaction product of a higher linear alcohol and a mixture of ethylene and propylene oxides, containing a mixed chain of ethylene oxide and propylene oxide, terminated by a hydroxyl group.

In the preferred poly-lower alkoxylated higher alkanols, to obtain the best balance of hydrophilic and lipophilic moieties, the number of lower alkoxides will usually be from 40% to 100% of the number of carbon atoms in the higher alcohol, preferably 40 to 60% thereof and the nonionic detergent will preferably contain at least 50% of such preferred poly-lower alkoxy higher alkanol. Higher molecular weight alkanols and various other normally solid nonionic detergents and surface active agents may be contributory to gelation of the liquid detergent formulations and consequently, will preferably be omitted or limited in quantity in the present liquid compositions, although minor proportions thereof may be employed for their cleaning properties, etc. With respect to both preferred and less preferred nonionic detergents, the alkyl groups present therein will most preferably be linear although a minor degree of slight branching may be tolerated, such as at a carbon next to or two carbons removed from the terminal carbon of the straight chain and away from the ethoxy chain, if such branched alkyl is no more than three carbons in length. Normally the proportion of carbon atoms in such a branched configuration will be minor, rarely exceeding 20% of the total carbon atom content of the alkyl. Similarly, although linear alkyls which are terminally joined to the ethylene oxide chains are highly preferred and are considered to result in the best combination of detergency, biodegradability and non-gelling characteristics, medial or secondary joinder to the ethylene oxide in the chain may occur. It is usually in only a minor proportion of such alkyls, generally less than 50% but, as is in the case of, for example, the Tergitols, may be greater. Also when propylene oxide is present in the lower alkylene oxide chain, it will usually be less than 20% thereof and preferably less than 10% thereof, although higher percentages may also be used as in some of the Plurafacs.

The amount of the nonionic will generally be the minimum amount which when added to the wash water will provide adequate cleaning performance. Generally, amounts ranging from about 1 to about 50%, preferably from about 10 to about 40%, and especially preferably from about 12 to 35% by weight of the composition, can be used.

A second essential ingredient in the instant formulations is the cationic fabric softener. Softening agents are used to render fabrics or textiles soft, and the terms "softening" and "softener" refer to the handle, hand, touch or feel; this is the tactile impression given by fabrics or textiles to the hand or body and is of aesthetic and commercial importance. The cationic fabric softeners used in the present invention are the mono-higher alkyl quaternary ammonium compounds represented by the following formula:

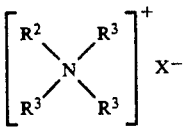

(III)

wherein $R^2$ is a long chain aliphatic radical having from 10 to 22 carbon atoms, and the three $R^3$'s are, independently, lower alkyl or hydroxy alkyl radicals and X is a water-soluble, salt-forming anion such as halide, i.e. chloride, bromide, iodide; sulfate; citrate, acetate; hydroxide; methosulfate; ethosulfate; phosphate; or similar inorganic or organic solubilizing radical. The carbon chain of the aliphatic radical containing 10 to 22 carbon atoms, especially 12 to 20, preferably 12 to 18, and especially preferably 16 to 18 carbon atoms, may be straight or branched, and saturated or unsaturated. The lower alkyl radicals have from 1 to 4 carbon atoms, preferably 1 or 2 carbon atoms, especially preferably methyl, and may contain a hydroxyl radical. Preferably, the long carbon chains are obtained from long chain fatty acids, such as those derived from tallow and soybean oil. The terms "soya" and "tallow", etc., as used herein refer to the source from which the long chain fatty alkyl chains are derived. Mixtures of the quaternary ammonium compound fabric softeners may be used. The preferred ammonium salt is a mono-higher alkyl trimethyl ammonium chloride wherein the alkyl group is derived from tallow, hydrogenated tallow or stearic acid. Specific examples of quaternary ammonium softening agents of the formula (III) suitable for use in the composition of the present invention include the following: tallow trimethyl ammonium chloride, hydrogenated tallow trimethyl ammonium chloride, trimethyl stearyl ammonium chloride, triethyl stearyl ammonium chloride, trimethyl cetyl ammonium chloride, soya trimethyl ammonium chloride, stearyl dimethylethyl ammonium chloride, tallow-diisopropylmethyl ammonium chloride, the corresponding sulfate, methosulfate, ethosulfate, bromide and hydroxide salts thereof, etc.

Another useful class of commercially available quaternary ammonium fabric softener compounds are the ethoxylated compounds of formula (IV):

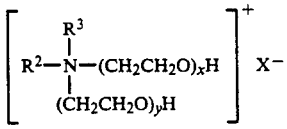

(IV)

wherein X, $R^2$ and $R^3$ are as defined for formula (III) and x and y are each positive numbers of at least 1 and the sum x+y is from 2 to 15.

An especially preferred compound of formula (IV) is sold by Armak under the trademark Ethoquad 18/12 ($R^3=CH_3$—, $R^2=C_{18}$ alkyl, x+y=2).

The amount of the monoalkyl quaternary cationic fabric softener can generally range from about 1 to about 20%, preferably from about 2 to about 16%, and especially preferably from about 2 to 10%, by weight of the composition.

The weight ratio of the nonionic surface active agent to the cationic fabric softener can be within the range of from about 1:1 to 15:1, preferably from about 1.5:1 to 10:1, especially preferably from about 2:1 to 8:1.

The anionic detergents which are contemplated can generally be any of the anionics known to be useful in the formulation of detergents for cleaning soiled fabrics.

The most preferred anionic detergent is a sulfosuccinamate surfactant.

These compounds are characterized by having a 10 to 22 open chain hydrocarbon substituent bonded to the nitrogen atom of the carbonamide

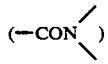

group present at one carboxy terminal end group of the succinamate moiety, and by the sulfonyl (—$SO_3$—) group bonded to one of the carbon atoms at the alpha- or beta-position with respect to the carbonamide group.

Examples of the sulfosuccinamate compound include disodium N-octadecyl sulfosuccinamate (available as Alkasurf SS-TA from Alkaril Chemicals, or as ASTROMID 18 from Alco Chemical Corp.), disodium N-oleyl sulfosuccinamate (available from Alkaril Chemicals as Alkasurf SS-OA); tetrasodium N-(1,2-dicarboxyethyl)N-octadecyl sulfosuccinamate (available as ASTROMID 22 from Alco Chemical Corp., as Monawet SNO-35 from Mona Industries, Inc. or Aerosol 22 from American Cyanamid Corp.).

More generally, however, suitable sulfosuccinamate compounds can be represented by the following general formula (V):

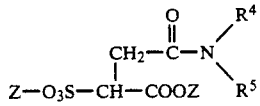

(V)

where Z is a monovalent salt-forming cation, such as alkali metal, ammonium and amine, $R^4$ is hydrogen, lower alkyl, carboxy(lower alkyl), or 1,2-dicarboxy(lower alkyl), and $R^5$ is an open chain hydrocarbon of from 10 to 22 carbon atoms.

As the alkali metal sodium potassium, or lithium are preferred and sodium is especially preferred.

The monovalent amine salt forming cation may be, for example, a mono-, di-, or tri-lower alkanolamine, such as mono-, di-, or triethanolamine.

The "lower alkyl" group can have from 1 to 5, preferably 1 to 3, especially preferably 1 to 2 carbon atoms.

The open chain hydrocarbon for $R^5$ may be saturated or unsaturated, and may be a straight chain or branched chain group, preferably an alkyl or alkenyl of from 14 to 18, especially 16 to carbon atoms, such as, for example, tallow, hydrogenated tallow, fractionated tallow, oleyl, octadecyl, stearyl, etc.

When $R^4$ is carboxy(lower alkyl) or 1,2-dicarboxy(lower alkyl), such as carboxyethyl, carboxypropyl, carboxy-2-methylethyl, 1,2-dicarboxyethyl, etc., the carboxyl group or groups may be in the form —COOY where Y is the group Z or lower alkyl; preferably Y is Z, especially preferably sodium.

The amount of the sulfosuccinamate must be carefully selected depending on such factors as the nature and amount of the nonionic surfactant and cationic fabric softener, the particular sulfosuccinamate, as well as the anticipated washing conditions, including, for example, type of fabrics, soils, wash temperature, water hardness, etc. Generally, however, best cleaning performance has been achieved when the amounts of sulfosuccinamate surfactant, nonionic surfactant and mono-higher alkyl cationic fabric softener are each in the following ranges—in parts by weight based on the total composition:

| | Broad | Preferred |
|---|---|---|
| (a) Nonionic surfactant | 10–50 | 12–35 |
| (b) Monoalkyl quaternary | 1–20 | 2–16 |
| (c) Sulfosuccinamate surfactant | 1–20 | 2–16 |

Within the above ranges the weight ratios of (a):(b), (a):(c) and (b):(c) are also important, although again, the optimum values may differ for different compounds and different washing conditions. For most cases, however, the ratios (a):(b) and (a):(c) are in the range of from about 15:1 to 1:1, preferably 10:1 to 1.5:1, especially preferably 8:1 to 2:1. The weight ratio of (b):(c) should generally be within the range of from about 3:1 to 1:3, preferably from about 2:1 to 1:2, especially preferably from about 1.3:1 to 1:2. further, the weigh ratio of (a):(b)+(c) is from about 10:1 to 1:1, preferably 6:1 to 1.5:1.

For example, in accordance with one preferred embodiment of the invention wherein the nonionic is a $C_{12}$–$C_{15}$ alcohol ethoxylated with an average of 7 moles ethylene oxide per mole of alcohol, (such as the Shell Oil Co. product Neodol 25-7) in an amount of from about 15 to 25% by weight of the total composition, the monoalkyl quaternary fabric softener is tallow trimethyl ammonium chloride, and the sulfosuccinamate is tetrasodium N-(1,2-dicarboxyethyl)-N-octadecyl sulfosuccinamate (e.g. Monawet SNO-35) the preferred ratios of the nonionic to quaternary and quaternary to the sulfosuccinamate are in the range of from about 12:1 to 4:1 and from about 1:1 to 1:2, respectively, under typical washing conditions, e.g. 120° F., 0.2% product concentration, 100 ppm hardness ions, for a broad range of fabrics and soils.

Other anionic detergents may be utilized in the present invention, in lieu of the sulfosuccinamate surfactant, but in a particularly preferred embodiment of the invention the sulfosuccinamate surfactant is utilized in conjunction with an anionic surfactant.

Thus, as disclosed in the applicant's aforementioned copending application Ser. No. 661,775, the softening and anti-static performance of the mixture of nonionic surfactant and mono-higher alkyl quaternary ammonium compound fabric softening agent is significantly enhanced by the use of a linear alkyl aromatic sulfonate surfactant, preferably as a 1:1 molar complex with the quaternary fabric softener.

Examples of suitable anionic surfactants include the water-soluble salts, e.g. the sodium, potassium, ammonium, alkylolammonium salts of higher linear alkyl aromatic sulfonates containing about 8 to 26 carbon atoms, preferably 10 to 22 carbon atoms, in the alkyl radical. (The term alkyl includes the alkyl portion of the higher acyl radical.)

Preferred examples of the linear alkyl aromatic sulfonates are those containing from 10 to 16 carbon atoms in the linear alkyl radical, e.g., the sodium, potassium, and ammonium salts of higher linear alkyl benzene sulfonates, higher linear alkyl toluene sulfonates, higher linear alkyl phenol sulfonates, and higher linear alkyl naphthalene sulfonates. The linear higher alkyl benzene sulfonates such as the $C_{10}$–$C_{16}$ alkyl, especially $C_{10}$–$C_{14}$ alkyl, for example $C_{12}$ (n-dodecyl) alkyl benzene sulfonates, are especially preferred anionic surfactants.

In addition to the linear alkyl aromatic sulfonates another preferred class o-anionic surfactants which can enhance the overall performance, especially anti-static and softening, of the invention detergent compositions include the alkyl ether sulfates of formula $R^6O(CH_2CH_2O)_p$—$SO_3M$, where $R^6$ is higher alkyl having from 8 to 20, especially 10 to 18, carbon atoms, M is a solubilizing salt-forming cation, such as an alkali metal ion, alkaline earth metal ion, ammonium ion, ammonium ion substituted with from 1 to 3 lower alkyls, or mono-, di- and tri-alkanolamines having 2 to 3 carbon atoms in the alkanol group or groups, and p is a number of from 2 to 8, preferably 2 to 6 (especially from 1/5 to ⅓ or ½ the number of carbon atoms in $R^6$). A preferred polyethoxylated alcohol sulfate surfactant is available from Shell Chemical Company and is marketed as Neodol 25-3S. This material, the sodium salt, is normally sold as a 60% active ingredient product in an aqueous solvent medium. Although Neodol 25-3S is the sodium salt, the potassium salt and other suitable soluble salts of the triethenoxy higher alcohol (12 to 15 carbon atoms) sulfate and other such compounds herein described, such as have already been referred to and those described below, may also be used in partial or complete substitution for the sodium salts. As with the various materials of the present compositions, mixtures thereof may be utilized.

Examples of the higher alcohol polyethenoxy sulfates which may be employed as the anionic surfactant constituent of the present liquid detergents or as partial substitutes for this include: mixed $C_{12-15}$ normal or primary alkyl triethenoxy sulfate, sodium salt; myristyl triethenoxy sulfate, potassium salt; n-decyl diethenoxy sulfate, diethanolamine salt; lauryl diethenoxy sulfate, ammonium salt; palmityl tetraethenoxy sulfate, sodium salt; mixed $C_{14-15}$ normal primary alkyl mixed tri- and tetraethenoxy sulfate, sodium salt; stearyl pentaethenoxy sulfate, trimethylamine salt; and mixed $C_{10-18}$ normal primary alkyl triethenoxy sulfate, potassium salt. Minor proportions of the corresponding branched chain and medially alkoxylated detergents, such as those described above but modified to have the ethoxylation at a medial carbon atom, e.g. one located four carbons from the end of the chain, may be employed and the carbon atom content of the higher alkyl will be the same. Similarly, the joinder to the normal alkyl may be at a secondary carbon one or two carbon atoms removed from the end of the chain. In either case, as previously indicated, only minor proportions should be present, such as 10 or 20%, in the usual case.

As is the case with the preferred nonionic detergents, the present poly-lower alkoxy higher alkanol sulfates are readily biodegradable and of better detergency when the fatty alkyl is terminally joined to the poly(-lower oxyalkylene) chain, which is terminally joined to the sulfate. Again, as in the case of the nonionic detergents, a small proportion, for example, not more than 10%, of branching, and medial joinder are tolerable. Generally, it will be preferred for the alkyl in the anionic alkoxylate surfactant as in the nonionic detergent to be a mixture of different chain lengths, as 11, 12, 13, 14 and 15 carbon atoms or 12 and 13 carbon atom chains, rather than all of one chain length. Nevertheless, the invention is applicable to liquid detergents containing pure nonionic and anionic components.

Of course, ethylene oxide is the preferred lower alkylene oxide of the anionic alkoxylate surfactant, as it is with the nonionic detergent, and the proportion thereof in the polyethoxylated higher alkanol sulfate is preferably 2 to 5 mols of ethylene oxide groups present per mol of anionic surfactant and in more preferred compositions from 2 to 4 mols will be present, with three mols being most preferred, especially when the higher alkanol is of 12 to 13 carbon atoms or 11 or 12 to 15 carbon atoms. To maintain the desired hydrophile-lipophile balance, when the carbon atom content of the alkyl chain is in the lower portion of the 10 to 18 carbon atom range, the ethylene oxide content of the detergent may be reduced to about two mols per mol; whereas, when the higher alkanol is of 16 to 18 carbon atoms, in the higher part of the range, the number of ethylene oxide groups may be increased to 4 or 5 and in some cases to as high as 8 or 9. Similarly, the salt-forming cation may be altered to obtain the best solubility. It may be any suitable solubilizing metal or radical but will most frequently be alkali metal, e.g. sodium, or ammonium. If lower alkylamine or alkanolamine groups are utilized, the alkyls and alkanols will usually contain from 1 to 4 carbon atoms and the amines and alkanolamines may be mono-, di- and tri-substituted, as in monoethanolamine, diisopropanolamine and trimethylamine.

The poly-lower alkoxy higher alkanol sulfates and the linear alkyl aromatic sulfonates, are highly preferred anionic surfactants in the presencompositions but other anionic surfactants may be employed with them or in place of such compounds. Particularly, alpha-olefin sulfonates, paraffin sulfonates and higher alcohol sulfates may be used. The olefin sulfonate salts generally contain long chain alkenyl sulfonates or long chain hydroxyalkate sulfonates (with the OH being on the carbon atom which is not directly attached to the carbon atom bearing the —$SO_3H$ group). The olefin sulfonate detergent usually comprises a mixture of such types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580 and British Patent No. 1,129,158. The number of carbon atoms in the olefin sulfonate is usually within the range of 10 to 25, more commonly 10 to 20, or 12 to 18, e.g. a mixture principally of $C_{12}$, $C_{14}$ and $C_{16}$, having an average of about 14 carbon atoms, or a mixture principally of $C_{14}$, $C_{16}$ and $C_{18}$, having an average of about 16 carbon atoms.

Another class of useful anionic surfactant is that of the higher paraffin sulfonates. These may be primary or secondary paraffin sulfonates made by reacting long chain alpha-olefins and bisulfites, e.g. sodium bisulfite, or paraffin sulfonates having the sulfonate groups distributed along the paraffin chain, such as the products made by reacting a long chain paraffin with sulfur dioxide and oxygen under ultraviolet light, followed by neutralization with sodium hydroxide or other suitable base (as in U.S. Pat. Nos. 2,503,280; 2,507,088; 3,260,741; 3,372,188, and German Patent 735,096). The paraffin sulfonates preferably contain from 13 to 17 carbon atoms and will normally be the monosulfonate but if desired, may be di-, tri- or higher sulfonates. Typically, the di- and polysulfonates will be employed in admixture with a corresponding monosulfonate, for example, as a mixture of mono- and di-sulfonates containing up to about 30% of the disulfonate. The hydrocarbon substituent thereof will preferably be linear but if desired, branched chain paraffin sulfonates can be employed, although they are not as good with respect to biodegradability. The paraffin sulfonate may be terminally sulfonated or the sulfonate substituent may be joined to the 2-carbon or other carbon atom of the chain and, similarly, any di- or higher sulfonate employed may have the sulfonate groups distributed over different carbons of the hydrocarbon chain.

The paraffin sulfonates and olefin sulfonates are used in the form of their alkali metal, e.g. sodium and potassium, ammonium, or mono-, di-, and tri-loweralkanolamine salts, or mixtures thereof. Triethanolamine is the preferred alkanolamine salt forming cation. The linear alkylbenzene sulfonates and alkyl ether sulfates are especially preferred as the anionic surfactant.

These anionic surfactants can not only interact with the mono-higher alkyl quaternary compound to improve softening and anti-static performance but also function to cause various additional optional detergent adjuvants, as described in detail more fully below, especially optical brighteners, to deposit more effectively on the fabrics being laundered.

Although no specific rules can be applied for every combination of ingredients and for all washing conditions, it has been observed as a general rule that as between the two preferred classes of anionic surfactants, the linear alkyl benzene sulfonates are usually slightly more effective than the alkyl ether sulfates in terms of softening performance but slightly inferior in terms of cleaning performance—although the addition of any anionic surfactant often provides only slight improvements in cleaning performance as compared to the same composition without anionic surfactant. Naturally mixtures of two or more of the anionic surfactants can be used.

Since the anionic surfactant presumably forms a complex with the cationic softener to provide the enhanced softening/anti-static performance without interfering with, or slightly improving, the cleaning performance of the nonionic or with the brightener, in the detergent formula, the ratio of cationic to anionic is particularly critical since large excesses of either component could interfere with overall performance. Accordingly, ratios of cationic to anionic of from about 1.3:1 to 1:1.5, preferably 1.2:1 to 1:1.2, especially preferably 1.1:1 to 1:1.1 and most preferably about 1:1 will provide improved softening performance and anti-static performance, as well as improved whitening and perhaps cleaning.

The total amount of the cationic/anionic softener mixture in the composition generally will range from about 2 to 20%, preferably 5 to 15%, by weight based on the total composition. Moreover, the total amount of cationic softener and anionic surfactant will generally be in the range of from about 20 to 100%, preferably 30 to 80%, by weight, based on the nonionic surfactant. Furthermore, within the above amounts and ratios, the cationic/anionic softener mixture will be compatible with the nonionic surfactant, sulfosuccinamate and the optical brightener, etc.

In any event, the total amount of anionic detergent should be within the range of 1 to 30% by weight of the total composition, preferably, 2 to 26% by weight. Preferably, the anionic detergent comprises a sulfosuccinamate compound and an anionic surfactant selected from the group consisting of linear higher alkyl aromatic sulfonate, poly(lower alkoxy)higher alkanol sulfonate, olefin sulfonate and paraffin sulfonate with the sulfosuccinamate compound being present in an amount of 2 to 20% by weight of the total composition and the anionic surfactant being present in an amount of up to 10% by weight of the total composition Most preferably, the weight ratio of the cationic fabric softener-anti-static agent to the sulfosuccinamide compound is in the range of from about 3:1 to 1:3; and the weight ratio of the cationic fabric softener-anti-static agent to said anionic surfactant selected from the group consisting of linear higher alkyl aromatic sulfonate, poly(lower alkoxy)-higher alkanol sulfonate, olefin sulfonate and paraffin sulfonate is in the range of from about 1.3:1 to 1:1.5. Additionally, it is preferred that the weight ratio of the sulfosuccinamate compound to the anionic surfactant selected from the group consisting of linear higher alkyl aromatic sulfonate, poly(lower alkoxy)higher alkanol sulfonate, olefin sulfonate and paraffin sulfonate is in the range of from about 1.3:1 to about 1:1.5, most preferably, about 1.2:1 to 1:1.2.

The soil release promoting polymer which as a water-soluble fraction is an essential component of the compositions of this invention is a polymer of polyethylene terephthalate and polyoxyethylene terephthalate which is dispersible in water and is depositable from wash water containing nonionic detergent onto synthetic organic polymeric fibrous materials, especially polyesters and polyester blends, so as to impart soil release properties to them, while maintaining them comfortable to a wearer and not preventing or significantly inhibiting vapor transmission through them. Such polymers have also been found to possess anti-redeposition properties. They tend to maintain soil, such as oily soil, dispersed in wash water during washing and rinsing, so that it is not redeposited on the laundry. Useful products are copolymers of ethylene glycol or another suitable source of ethylene oxide moiety, such as polyoxyethylene glycol and terephthalic acid or a suitable source of the terephthalic moiety. The copolymers may also be considered to be condensation products of polyethylene terephthalate, sometimes referred to as ethylene terephthalate polymer, and polyoxyethylene terephthalate. While the terephthalate moiety is preferred as the sole dibasic acid moiety in the polymer, it is within the scope of the invention to utilize relatively small proportions of isophthalic acid and/or orthophthalic acid (and sometimes other dibasic acids) to modify the properties of the polymer However, the proportions of such acids will normally be less than 10% of the phthalic moieties present in the final polymer, and, preferably, less than 5%.

The weight average molecular weight of the polymer may be as low as 8,000 or as high as 60,000. In the polymers utilized the polyoxyethylene will be of a molecular weight in the range of about 500 to 10,000 preferably about 2,500 to 5,000, more preferably 3,000 to 4,000. In such polymers, the molar ratio of polyethylene terephthalate units (A)

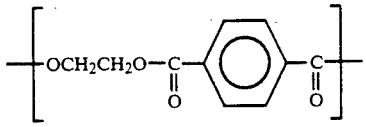

(A)

to polyoxyethylene terephthalate units (B)

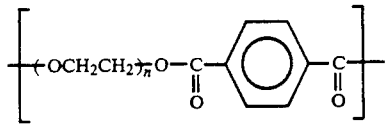

(B)

will be within the range of 2:1 to 6:1, preferably 5:2 to 5:1, most preferably 3:1 to 4:1. The proportion of ethylene oxide to phthalic moiety in the polymer will be at least 10:1, preferably 20:1 or more, and most preferably within the range of 20:1 to 30:1.

Although suitable methods for making these polymers are described in the literature, such polymers may be considered as having been randomly constructed from polyethylene terephthalate and polyoxyethylene terephthalate moieties such as may be obtained by reacting polyethylene terephthalate (e.g., spinning-grade) and polyoxyethylene terephthalate or reacting the ethylene and polyoxyethylene glycols and acid (or acid precursor) thereof.

The described materials are available from various sources. Useful copolymers for the manufacture of the water-soluble fraction of the present invention are marketed by Alkaril Chemicals, Inc. and commercial products of such company are sold by them under the trademarks Alkaril QCJ and Alkaril QCF. Products available from them in limited quantities, designated 2056-34B and 2056-41 have also been found to be useful. The QCJ product, normally supplied as an aqueous dispersion (about 15% solids) is also available as an essentially dry solid, i.e. the QCF product. When it is anhydrous or low in moisture content (less than about 2% moisture), it looks like a light brown wax in which the molar ratio of ethylene oxide to phthalic moiety is about 22:1. In a 16% dispersion, the viscosity at 100° F. is about 96 centistokes. The 2056-41 polymer is like a hard, light brown wax and the ethylene oxide to phthalic moiety ratio is about 16 to 1, with the viscosity, under the same conditions as previously mentioned, being about 265 centistokes. The 2056-34B polymer appears to be a hard, brown wax in which the molar ratio of ethylene oxide to phthalic moiety is about 10.9 to 1, and its viscosity, under the same conditions as previously mentioned, is about 255 centistokes. The QCJ/QCF polymers have melting points (differential thermal analysis) of about 50°-60° C., a carboxyl analysis of 5 to 30 equivalents/$10^6$ grams, and a pH of 6-8 in distilled water at 5 weight % concentration.

In order to produce the water-soluble fraction of the polymer utilized in the present invention, the above-noted polymers are subjected to a cold filtration process while in aqueous dispersion.

This cold filtration process separates a "water-insoluble" fraction as a precipitate which is rich in polyethylene terephthalate and exhibits little or no soil release activity. The filtrate contains a "water-soluble" fraction which exhibits soil release activity and is rich in polyoxyethylene terephthalate. The filtrate may be further separated into active fractions by extraction with an organic solvent, e.g., a polar organic solvent such as ah alkyl halide, especially a lower alkyl halide, e.g., methylene chloride.

In particular, a 5-10% by weight aqueous dispersion of the polyethylene terephthalate-polyoxyethylene terephthalate polymer is chilled to less than 40° F. and then filtered to recover insoluble material. The filtrate, so-produced, constitutes the "water-soluble" fraction of a polyethylene terephthalate-polyoxyethylene terephthalate soil release promoting polymer used in the present invention. This "water-soluble" fraction may be further extracted with an alkyl halide solvent, such as methylene chloride, to form two sub-fractions either of which may be used in lieu of the total "water-soluble" fraction.

As will be readily recognized, filtration may be replaced by any other technique suitable for solid-liquid separation, e.g., decantation, centrifugation, etc. Likewise, the "water-soluble" fraction may be recovered by drying of the dispersion(s).

The liquid carrier for the instant liquid detergent composition is preferably an aqueous one, and may be water alone or may be substantially water with additional solvents added for solubilizing particular ingredients, as is well known in the art. Because of the availability of water and its minimum cost, it is preferred to use water as the major solvent present. Yet, amounts of other solvents, generally up to 20%, and preferably a maximum of 15% of the total content, may be used. Generally, such a supplementing solvent will be either a lower alkanol or a lower diol or polyol, e.g. ethanol, isopropanol, ethylene glycol, propylene glycol, glycerol, or the like. Etheric polyols such as diethylene glycol and those known as cellosolves may also be used.

In addition to the supplemental solvent, it is also generally preferred to include a hydrotropic material in the formulation to maximize the compatibility of all of the active ingredients and to make the liquid formulation more homogeneous and stable. Examples of suitable hydrotropes include the alkali metal aryl sulfonates, such as sodium benzene sulfonate, sodium toluene sulfonate, sodium xylene sulfonate, and the corresponding potassium salts. The hydrotrope can be used in amounts up to about 15%, preferably up to 10% by weight of the total composition, for example, 1 to 8%, or 2 to 6%. Although the aqueous carriers are preferred, non-aqueous liquid carriers, such as the organic cosolvents mentioned above, may be used as the sole or major liquid carrier, i.e. the non-aqueous liquid carriers may comprise from about 50 to 100% by weight of the liquid carrier, the balance, if any, constituting water and/or hydrotropic material. Mixtures of two or more organic solvents may also be used.

Various selected compatible adjuvants may also be present in the detergent composition to give it additional desired properties, either of functional or aesthetic nature. Thus, there may be included in the formulation: enzymes, e.g. proteases, amylases, lipases, etc., and mixtures thereof; bleaching agents; bleach activators and stabilizers; soil-suspending or anti-redeposition agents, e.g. polyvinyl alcohol, sodium carboxymethyl cellulose, hydroxypropyl methyl cellulose; dyes, bluing agents, pigments, optical brighteners, e.g., cotton: amide and polyester brighteners; bactericides, e.g. hexachlorophene; preservatives, e.g. methyl parasept or sodium benzoate; ultraviolet absorbers; pH modifying agents, e.g. amines, pH buffers; opacifying agents, e.g. behenic acid, polystyrene suspensions, etc.; and perfumes. The adjuvants, of course, will be chosen to be compatible with the main constituents of the detergent formulation.

Of the adjuvants mentioned perhaps the most important for functional effect are the optical brighteners because the modern housewife has come to expect that washed clothing will no longer merely be clean and white but will also be bright in appearance. The optical brighteners are substantive to textiles being washed (such substantivity may be selective) and sometimes are of comparatively low solubilities. Accordingly, it is important that they be maintained in solution in the liquid detergent composition and, even more important, they must be immediately dispersed in the wash water so as to avoid producing a wash containing noticeable brightened spots, rather than a uniformly bright appearance. Here, the choice of brightener to obtain best results will be ascertainable to one of skill in the art. It has been found that relatively small quantities of brighteners should be used, so as not to exceed the limits of solubilities. Also, within the class of these materials certain brighteners have been found to be especially readily dissolved, and thus are suitable for incorporation in these products. Fortunately, such preferred brighteners include both cotton and amide-polyester-brighteners, making them suitable for use with laundries containing a variety of material and synthetic materials. Among the commercial brighteners that are used in the present system are Tinopal UNPA, Tinopal CBS, Tinopal 5BM (Ciba-Geigy), Arctic White CC, Artic White CWD (Hilton Davis), and the following Phorwhites from Verona: BHC, BKL, BUP, BBH solution BRV solution, DCR liquid, DCBVF, EV liquid, DBS liquids and ANR.

Other types of optical brighteners which give superior whitening effects are those components having no sulfonate moieties. The preferred class of brighteners for use in the present invention include the 2-(4-styrylphenyl)-2H-naphthol[1,2-d] triazoles, 4,4'-bis(1,2,3-triazol-2-yl)stilbenes, 4,4'-bis(styryl) bisphenyls, and the y-aminocoumarins. Specific examples of these brighteners include 4-methyl-7-diethylamino coumarin, 1,2-bis(-benzimidazol-2-yl)ethylene, and the 1,3 -diphenylphrazolines, as well as 2,5-bis(benzoxazol-2-yl) thiophene, 2-styryl-naphth [1,2-d] oxazole, and 2-(stilben-4-yl)-2H-naphtho[1,2-d]triazole.

The optical brightener content of the liquid composition will normally be from about 0.2% to about 3.0%, and preferably from 0.25 to 2.7%. Such concentrations are soluble in the described liquid detergents and are effective in noticeably brightening the washed clothing. As mentioned above, the presence of the anionic surfactant can enhance the uniform deposition of the optical brightener.

The contents of the other adjuvants is preferably maintained at less than 5%, preferably less than 3%, by weight of the product. Use of more than the described proportions of the such compounds can often significantly change the properties, e.g. stability, of the liquid detergent, and therefore should be avoided.

Although the liquid detergent softener composition of the present invention is a stable, clear one-phase liquid, a compatible opacifying agent may be added to impart a creamy appearance to the formulation.

Still another optional but highly preferred ingredient in the present detergent compositions is an ethoxylated fatty amine, such as the Ethomeen® series of compounds of Armak Company and the Varonic® series from Ashland Chemicals. These compounds can be represented by the general formula

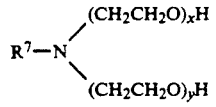

where $R^7$ is a fatty alkyl group of from about 10 to 22, preferably 12 to 18, carbon atoms and the sum of x+y is from about 2 to about 15. The $R^7$ group may be saturated or unsaturated, and, for example, may be derived from coco fatty acid, oleic acid, soya fatty acid, tallow fatty acid, stearic acid, or mixtures of these acids.

The ethoxylated amines contribute to improve cleaning, softening and static control. Usually amounts of the ethoxylated amine up to about 15%, preferably up to about 10%, for example 1–10%, or 1–8%, especially 2–8%, by weight of the total liquid composition are satisfactory.

To assist in solubilizing the detergents and optical brighteners which may be present in the liquid detergents a small proportion of alkaline material or a mixture of such materials is often included in the present formulations. Suitable alkaline materials include mono-, di- and trialkanolamines, alkyl amines, ammonium hydroxide and alkali metal hydroxides. Of these, the preferred materials are the alkanolamines, preferably the trialkanolamines and of these, especially triethanolamine. The pH of the final liquid detergent, containing such a basic material will usually be neutral or slightly basic. Satisfactory pH ranges are from 7 to 10, preferably about 7.5 to 9.5, but because of pH reading of the liquid detergent, using a glass electrode and a reference calomel electrode, may be inaccurate, due to the detergent system often being essentially non-aqueous, a better indication is obtained by measuring the pH of a 1% solution of the liquid detergent in water. Such a pH will also normally be in the range of about 7 to 10, preferably 7.5 to 9.5. In the wash water, the pH will usually be in this range or might be slightly more acidic, as by 0.5 to 1 pH unit, due to the organic acid content of soiled laundry. For the liquid formulations, the viscosity at 25° C. will be in the range of 40 to 1000 centipoises, preferably from 40 to 500 centipoises, according to measurements that are made with a Brookfield viscosimeter at room temperature, suing a No. 1 spindle at 12 revolutions per minute.

The liquid composition is usually added to wash water in an automatic washing machine of either the top loading or front loading type so that the concentration thereof in the wash water may range from about 0.05 to 1.5%, usually 0.1 to 1.2%. Generally, depending on the type of machine and the degree of loading with the soiled fabrics, the amount of the liquid formulation to be added will range from about ¼ cup to about 1 ¼ cup, with the typical amount being about ½ cup (120 milliliters).

The wash water used may be a fairly soft water or water of reasonable hardness, and will generally and preferably be used at elevated temperature, especially at about 100° F. or higher, such as 120° F. to 180° F. or higher. The composition of the present invention is also useful in laundering clothes in very hard waters and at lower temperatures. Thus, water hardness may range from 0 to over 300 parts per million calculated as calcium carbonate, and washing temperatures may be from 40° to 120° F. or higher. Washing will be effected in an automatic washing machine in which the washing is followed by rinsing and spin or other draining or wringing cycles or operations. Of course, the detergent composition may also be used for hand washing of laundry, in which case it may sometimes be used full strength on certain strains on the laundry, or the laundry may be soaked in a higher concentration solution of detergen- before washing.

The washing operations will generally take from three minutes to one hour, depending on the fabrics being washed and the degrees of soiling observed. After completion of washing and the spinning, draining or wringing operations, it is preferred to dry the laundry in an automatic dryer soon thereafter but line drying may also be employed.

The present detergent-softener composition dissolves very easily whether the wash water is warm or cold, and very effectively cleans, softens and eliminates static charge on clothing and other items of laundry without imparting a water repellant finish thereto. It may be used in either top loading or front loading washing machines and may be desirably adjusted to foam to the correct extent. The product is an attractive clear, stable liquid which maintains its activity and uniformity over a long shelf life. In tests in which the effects of using it are compared to those from the employment of commercial liquid laundry detergents, it rated very favorably.

This product may be prepared by simply admixing the various ingredients at room temperature with agitation to ensure solubilization thereof in the aqueous medium. The order of addition of ingredients and the temperature of compounding may be varied without adversely affecting the formation of the single phase, clear liquid product of instant invention.

The detergent-softener composition of the present invention exhibits many desirable characteristics with regard to both physical properties and performance in use. As to its physical properties, the liquid compositions are pourable and free-flowing from the container as manufactured and after aging. They exhibit a high degree of stability upon storage at normal room temperature of the order of about 70° F. over a period of many months without any appreciable precipitation. As a result, the consumer can utilize them conventionally by addition of very small portions to a laundering bath, and the detergent and softener will be present in constant composition in each portion. While compatible adjuvant materials may be added to render the final product translucent or opaque as desired, the requirement for a one phase solution of the main ingredients insures that effective washing and softening power will be obtained with each portion and promotes the stability and homogeneity of the product. The composition may be packaged in any suitable container or packaging material such as metal, plastic or glass.

The following specific examples illustrate various embodiments of the present invention. It is to be understood, however, that such examples are presented for purpose of illustration only, and the present invention is in no way to be deemed as limited thereby.

EXAMPLE 1—Preparation of Water-Soluble Fraction of Polyethylene Terephthalate-Polyoxyethylene Terephthalate Polymer 10.0 grams of Alkaril QCF (Alkaril Chemicals, Inc.) was dissolved/dispersed in 120 ml of water at 95° C. with stirring for five minutes The dispersion/solution was chilled to near freezing and then filtered to recover 2.2 grams of insoluble material (Fraction 1). The filtrate was extracted with methylene chloride and then the extract was evaporated to recover 3.5 grams of a second solid (Fraction 2). The remaining aqueous dispersion/-solution was then evaporated to dryness and 3.0 grams of a third solid (Fraction 3) was recovered. Each of the fractions was characterized as set forth in the following Table 1.

TABLE 1

| | Fraction 1 | Fraction 2 | Fraction 3 |
|---|---|---|---|
| Relative Amount of Recovered Solids % | 25 | 40 | 35 |
| Water Soluble | NO | YES | YES |
| $CH_2Cl_2$ Extractable | — | YES | NO |
| Melting Point (°C.) | 96–150 | 47–51 | 45–52 |
| Infra-Red Ratio of Ether to Ester | 1.4 | 4.0 | 2.6 |
| ESCA Ration of Ether Carbons to Aromatic Carbons | 1.6 | 16 | — |
| Soil Release (%) | 4 | 92 | 95 |

Example 2—Preparation of an Aqueous Laundry Detergent Composition

The following ingredients were mixed to form an aqueous laundry detergent composition:

| | Active Ingredient (%) |
|---|---|
| $C_{12-15}$ Alcohol · 7 Ethylene Oxide (Neodol 25-7, Shell) | 21 |
| Tallow Trimethyl Ammonium Chloride (Arguad T-50, Armak) | 4 |
| Linear Dodecyl Benzene Sulfonate | 4 |
| N-(1,2-Dicarboxyethyl) N-Alkyl ($C_{18}$) Sulfosuccinamate, Tetrasodium (Monawet SNO, Mona) | 4 |
| Sodium Xylene Sulfonate | 4 |
| "Water-Soluble" QCF (Fraction #3, Example 1) | 1 |
| Water (and incidental impurities) | QS |

In contrast, when QCF (i.e. untreated QCF) is utilized in lieu of the water-soluble fraction, a fine precipitate settles out on aging within 1 day at 110° F.

Example 3—Dirty Motor Oil Release Tests

Clean swatches of various types were washed in a standard automatic washing machine of the top loading type, having a washing drum of 17 U.S. gallons capacity After addition of the swatches in a standard wash load of about eight pounds, sufficient liquid detergent composition was added to the wash water to provide a detergent composition concentration of 0.22% by weight, the wash water being of about 100 ppm hardness as calcium carbonate, and having a temperature of 120° F. Two swatches were employed for each of three different fabrics, i.e. single knit Dacron®, double knit Dacron®, and Dacron®/cotton blend (65/35). The fabrics were washed using a normal wash cycle for the washing machine, including rinsing, and subsequently the swatches were dried.

After drying, the swatches were soiled in the center thereof with equal volumes (about three drops) of used dirty motor oil and then they were rewashed with the same detergent composition. Whiteness readings (Rd Values) of the stained area of the swatches were taken, using a reflectometer. Because such readings represent whiteness and the used motor oil was black, the readings were directly proportional to effectiveness of the soil release promoting action of the detergent containing the polyethylene terephthalate-polyoxyethylene terephthalate-copolymer or fraction thereof. The same test was run on controls, in which the swatches were first washed in the detergent composition minus the polyethylene terephthalate-polyoxyethylene terephthalate copolymer, subsequently, stained with the dirty motor oil, and then rewashed with the same control composition. Tests were conducted on freshly prepared detergent compositions (initial) and aged detergent compositions (1 wk at 110° F.). The results are set forth in Table 2.

TABLE 2

| | Rd Value | | | | | |
|---|---|---|---|---|---|---|
| | Dacron Single Knit | | Dacron Double Knit | | Dacron/ Cotton | |
| Composition | Initial | Aged | Initial | Aged | Initial | Aged |
| A(1) | 87.0 | 85.8 | 85.0 | 85.4 | 80.9 | 80.5 |
| B(2) | 87.1 | 80.1 | 85.4 | 82.1 | 80.1 | 73.9 |
| C(3) | 43.9 | 46.4 | 43.8 | 48.0 | 60.8 | 63.2 |

(1)Composition of Example 2
(2)Composition of Example 2 with untreated QCF in lieu of "Water-Soluble" QCF (Fraction #3, Example 1)
(3)Composition of Example 2 with no soil release promoting polymer of fraction thereof.

Thus, besides exhibiting excellent physical stability, the "water-soluble" fraction compositions exhibited excellent chemical stability.

What is claimed is:

1. A physically stable aqueous laundry detergent composition useful for washing and softening soiled fabrics comprising 10 to 50% by weight of a nonionic detergent, 1 to 30% by weight of an anionic detergent, 1 to 20% by weight of a cationic fabric softener-antistatic agent and a 0.5 to 20% by weight of a water-soluble polyethylene terephthalate-polyoxyethylene terephthalate component, which component consists essentially of a water soluble fraction of a polyethylene terephtalate-polyoxyethylene terephthalate soil release promoting polymer dispersion wherein said water-soluble fraction of a polyethylene terephthalate-polyoxyethylene terephthalate soil release promoting polymer is produced by forming a first 5–10% by weight aqueous dispersion of a polyethylene terephthalate-polyoxyethylene terephthalate copolymer having a weight average molecular weight of from about 8,000 to 60,000, wherein the polyoxyethylene has a molecular weight in the range of about 500 to 10,000, the molar ratio of polyethylene terephthalate units to polyoxyethylene terephthalate units is in the range of 2:1 to 6:1 and the proportion of ethylene oxide to phthalate moiety is at least 10:1, chilling said dispersion to produce a precipitate; removing said precipitate from said first aqueous dispersion to form second aqueous dispersion, and recovering said water-soluble fraction from said second aqueous dispersion.

2. The detergent composition of claim 1 wherein said anionic detergent comprises a sulfosuccinamate compound of the formula (I)

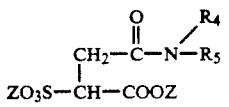

(I)

where

Z is a monovalent salt forming cation, $R_4$ is hydrogen, lower alkyl, carboxy(lower alkyl) or 1,2-dicarboxy(lower alkyl), and $R_5$ is an open chain hydrocarbon of from 10 to 22 carbon atoms.

3. The detergent composition of claim 1 wherein said anionic detergent is an anionic surfactant selected from the group consisting of linear higher alkyl aromatic sulfonate, poly(lower alkoxy) higher alkanol sulfate, olefin sulfonate and paraffin sulfonate.

4. The detergent composition of claim 1 wherein said anionic detergent comprises a sulfosuccinamate compound of the formula (I):

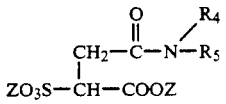

(I)

where

Z is a monovalent salt forming cation, $R_4$ is hydrogen, lower alkyl, carboxy(lower alkyl) or 1,2-dicarboxy(lower alkyl), and $R_5$ is an open chain hydrocarbon of from 10 to 22 carbon atoms; and an anionic surfactant selected from the group consisting of linear higher alkyl aromatic sulfonate, poly(lower alkoxy) higher alkanol sulfonate, olefin sulfonate and paraffin sulfonate.

5. The detergent composition of claim 4, wherein in formula (I):

Z is an alkali metal, ammonium or amine, $R_4$ is hydrogen, methyl, ethyl, carboxymethyl, carboxyethyl, 1,2-dicarboxymethyl or 1,2-dicarboxyethyl, and $R_5$ is a saturated or unsaturated, straight or branched chain alkyl or alkenyl group of from about 14 to 18 carbon atoms.

6. The detergent composition of claim 4, wherein said sulfosuccinamate compound is disodium N-octadecyl sulfosuccinamate, disodium N-oleyl sulfosuccinamate, or tetrasodium N-(1,2-dicarboxyethyl)N-octadecyl sulfosuccinamate.

7. The detergent composition of claim 1, which comprises 12 to 35% by weight of said nonionic detergent, 2–26% by weight of said anionic detergent, 2–16% by weight of said cationic fabric softener-anti-static agent, and 1 to 10% by weight of said water-soluble fraction of a polyethylene terephthalate-polyoxyethylene terephthalate soil release promoting polymer.

8. The detergent composition of claim 7, wherein said water-soluble fraction of a polyethylene terephthalate-polyoxyethylene terephthalate soil release promoting polymer is present in an amount of 2–5% by weight.

9. The detergent composition of claim 4, wherein the weight ratio of said nonionic detergent to said cationic fabric softener-anti-static agent is within the range of from about 15:1 to 2:1; the weight ratio of said cationic fabric softener-antistatic agent to said sulfosuccinamate compound is in the range of from about 3:1 to 1:3; and the weight ratio of said cationic fabric softener-antistatic agent to said compound selected from the group consisting of linear higher alkyl aromatic sulfonate, poly(lower alkoxy) higher alkanol sulfonate, olefin sulfonate and paraffin sulfonate is in the range of from about 1.3:1 to 1:1.5.

10. The detergent composition of claim 1, wherein prior to recovery of said water-soluble fraction from said second aqueous dispersion, said second aqueous dispersion is extracted with methylene chloride.

11. A physically stable aqueous liquid detergent composition for cleaning and softening soiled fabrics and which can be added to the wash cycle of an automatic laundry machine, said composition comprising:

(A) from about 10 to 50% by weight of a nonionic detergent selected from the group consisting of compounds of formulae (I) and (II):

$$RO(CH_2CH_2O)_nH \quad (I)$$

wherein R is a primary or secondary alkyl group of from about 8 to 22 carbon atoms and n is an average of from about 5 to 20;

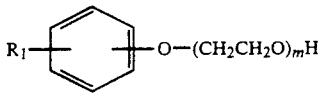

(II)

wherein $R_1$ is a primary or secondary alkyl group of from 4 to 12 carbon atoms and m is an average of from about 5 to 20;

(B) from about 1 to 20% by weight of a mono-higher alkyl quaternary ammonium compound of formulae (III) or (IV):

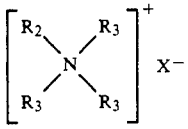

(III)

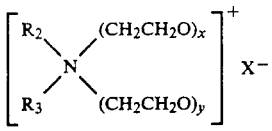

(IV)

wherein $R_2$ is a long chain aliphatic radical of from about 10 to 22 carbon atoms, each of the $R_3$'s in formula (III) and the $R_3$ in formula (IV) are independently lower alkyl or hydroxy (lower alkyl), X is a water-soluble salt-forming anion, and x and y are each positive number of at least 1 and the sum x+y is from 2 to 15;

(C) from about 1 to 20% by weight of a sulfosuccinamate detergent co mound of the formula (V):

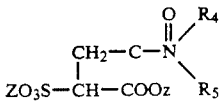

(V)

wherein Z is a monovalent salt forming cation, $R_4$ is hydrogen, lower alkyl, carboxyl (lower alkyl) or 1,2-dicarboxy (lower alkyl), and $R_5$ is an open chain hydrocarbon of from 10 to 22 carbon atoms;

(D) from about 0.5 to 20% by weight of a water-soluble polyethylene terephthalate-polyoxyethylene terephthalate component, which component consists essentially of a water soluble fraction of a polyethylene terephthalate-polyoxyethylene terephthalate soil release promoting polymer dispersion; wherein said water-soluble fraction of a polyethylene terephthalate-polyoxyethylene terephthalate soil release promoting polymer is produced by forming a first 5–10% by weight aqueous dispersion of a polyethylene terephthalate-polyoxyethylene terephthalate copolymer having a weight average molecular weight of from about 8,000 to 60,000, wherein the polyoxyethylene has a molecular weight in the range of about 500 to 10,000, the molar ratio of polyethylene terephthalate units to polyoxyethylene terephthalate units is in the range of 2:1 to 6:1 and the proportion of ethylene oxide to phthalate moiety is at least 10:1, chilling said dispersion to produce a precipitate; removing said precipitate from said first aqueous dispersion to form second aqueous dispersion, and recovering said water-soluble fraction from said second aqueous dispersion;

(E) up to about 10% by weight of an anionic surfactant selected from the group consisting of linear higher alkyl aromatic sulfonates, poly (lower alkoxy) higher alkanol sulfates, olefin sulfonates and paraffin sulfonates;

(F) up to about 3% by weight of an optical brightener;

(G) up to about 15% by weight of an ethoxylated amine;

(H) up to about 5% by weight of an alkaline substance;

(I) up to about 3% by weight of enzymes; and (J) aqueous solvent carrier.

12. The aqueous liquid detergent composition of claim 11, wherein the anionic detergent (E) is present at a ratio of (C):(E) of from about 1.3:1 to about 1:1.5.

13. The aqueous liquid detergent composition of claim 11, which comprises:

(A) from about 12 to 35%, (B) from about 2 to 16%, (C) from about 2 to 16%, (D) from about 1 to 10%, (E) in an amount of provide a ratio of (C):(E) of from about 1.2:1 to 1:1.2, (F) 0.2 to 2%, (G) up to about 10%, (H) up to about 3%, (I) up to about 2%, (J) balance.

14. The aqueous liquid detergent composition of claim 13, wherein said water-soluble fraction of a polyethylene terephtalate-polyoxyethylene terephthalate soil release promoting polymer is present in an amount of 2–5% by weight.

15. The composition of claim 13 wherein (A) is a compound of formula (I) wherein R is a $C_{12}$ to $C_{15}$ alkyl or mixture thereof and n is a number of from about 6 to 13;

(B) is tallowtrimethyl ammonium chloride;

(C) is disodium N-octadecyl sulfosuccinamate, disodium N-oleyl sulfosuccinamate, or tetrasodium N-(1,2-dicarboxyethyl) N-octadecyl sulfosuccinate, and (E) is linear dodecylbenzene sulfonate or triethenoxy ($C_{12}$–$C_{15}$) alkanol sulfate.

16. The composition of claim 11 which comprises (A) from about 15 to 25% of a compound of formula (I) wherein R is a $C_{10}$ to $C_{18}$ primary or secondary alkyl and n is from about 6 to 13;

(B) from about 2 to 16% of the sulfosuccinamate compound of formula (V) wherein $R^5$ has from about 14 to 18 carbon atoms and $R^4$ is hydrogen or 1,2-dicarboxyethyl, and an aqueous liquid carrier.

17. The composition of claim 16 wherein the ratio of (B):(C) is in the range of from about 1:1 to about 1:2.

* * * * *